United States Patent [19]

Yukimoto et al.

[11] 4,223,420

[45] Sep. 23, 1980

[54] HINGE STRUCTURE FOR AUTOMOBILE HOODS

[75] Inventors: Kazuyoshi Yukimoto, Toyota; Shinzi Ogasawara, Hekinan; Mitsuhiro Sakamoto, Toyota; Yasunori Kawamura, Nagoya, all of Japan

[73] Assignee: Aisin Seiki Company, Limited, Kariya, Japan

[21] Appl. No.: 948,916

[22] Filed: Oct. 5, 1978

[30] Foreign Application Priority Data

Oct. 5, 1977 [JP] Japan ..... 52-134109[U]

[51] Int. Cl.[2] ..... E05D 1/00

[52] U.S. Cl. ..... 16/128.1; 16/137; 16/140; 16/163; 16/180; 16/DIG. 33

[58] Field of Search ..... 16/128.1, 140, 180, 16/163, DIG. 33, 188, 137, 139; 180/69 R, 69 C

[56] References Cited

U.S. PATENT DOCUMENTS

| | | | |
|---|---|---|---|
| 1,921,261 | 8/1933 | Potter | 16/128.1 |
| 2,185,213 | 1/1940 | Claud-Mantle | 16/163 |
| 2,683,280 | 7/1954 | Martens | 16/128.1 |
| 2,904,822 | 9/1959 | Rhodes | 16/128.1 |
| 3,234,584 | 2/1966 | Valade | 16/128.1 |
| 3,351,975 | 11/1967 | Goto | 16/128.1 |

FOREIGN PATENT DOCUMENTS

| | | | |
|---|---|---|---|
| 2651410 | 5/1978 | Fed. Rep. of Germany | 16/128.1 |
| 948143 | 1/1964 | United Kingdom | 16/128.1 |

*Primary Examiner*—C. J. Husar
*Assistant Examiner*—Moshe I. Cohen
*Attorney, Agent, or Firm*—Oblon, Fisher, Spivak, McClelland & Maier

[57] ABSTRACT

A hinge structure for automobile hoods, including a first bracket fixedly connected to the automobile hood, a second bracket fixedly connected to an automobile body, a link mechanism rotatably supporting both brackets by a link mechanism, an urging mechanism for urging the first bracket into the raising direction thereof, the hinge structure characterized in that a link connecting member having an elastic portion is fixed to the autobomile body at the rotating position of the link mechanism upon fully opening the automobile hood and the link mechanism is connected to the link connecting member by bending the elastic member.

8 Claims, 6 Drawing Figures

HINGE STRUCTURE FOR AUTOMOBILE HOODS

BACKGROUND OF THE INVENTION

1. Field of the Invention

This invention relates to a hinge structure, and particularly to a hinge structure for automobile hoods or the like.

2. Description of Prior Art

It is known to provide a hinge structure for automobile hoods like that of a bracket fixedly attached to a hood and an automobile body which is rotatably connected by a plurality of links including and a link mechanism having a square shape or a multiple shape constructed as well as an urging mechanism such as a spring etc. for urging the bracket fixed to the hood into the rising direction thereof. In such case it is necessary to slowly open the hood and the spring force of the urging mechanism has a corresponding limit, therefore it is desirable that the spring moment of the urging mechanism is a slightly larger than the deadweight moment of the hood. However, when the hinge structure is constructed like as mentioned hereinabove, the holding force in the full opening position of the hood is not always enough and the hood is thus moved unsteadily. Accordingly, when the engine itself is repaired and inspected, a possible danger exists for example upon the occurence of a sudden gust of wind.

SUMMARY OF THE INVENTION

The main object of this invention is to provide a hinge structure for automobile hoods or the like which obviates the abovementioned drawbacks of conventional automobile hood.

A further object of the invention is to provide a hinge structure for automobile hoods or the like which is new in concept and highly simplified.

BRIEF DESCRIPTION OF THE DRAWINGS

Various other objects, features and attendant advantages of the present invention will be more fully appreciated as the same becomes better understood from the following detailed description when considered in connection with the accompanying drawings wherein like reference characters designate like or corresponding parts throughout the several views, and wherein.

DETAILED DESCRIPTION OF THE PREFERRED EMBODIMENT

Figure 1:
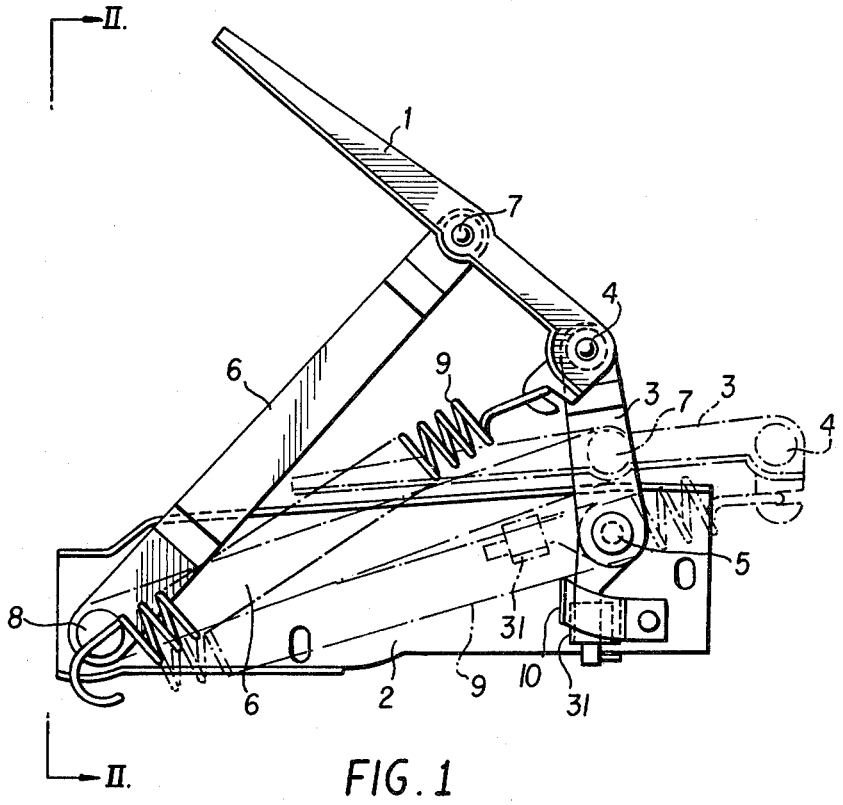
FIG. 1 shows a front view of a hinge structure for automobile hoods according to the invention.
Figure 2:
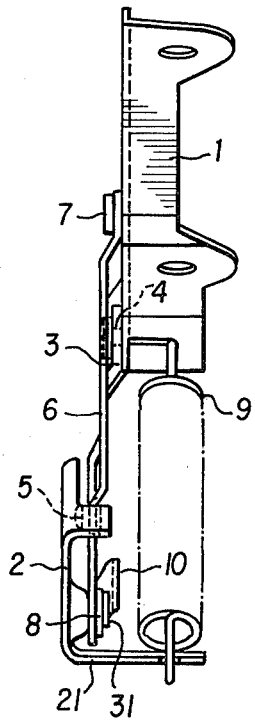
FIG. 2 shows a side view of a hinge structure for automobile hoods taken along line II—II of FIG. 1 according to the invention.

Referring now to the drawing especially to FIGS. 1 and 2, thereof, reference numeral 1 is a first bracket which is fixedly attached to a hood (not shown) and reference numeral 2 represents a second bracket which is fixedly attached to an automobile body (not shown). One end of a first link 3 is rotatably mounted on one end of the first bracket through a pin 4 and the other end thereof is rotatably mounted on one end of the second bracket 2 through a pin 5. One end of a second link 6 is rotatably mounted on the first bracket 1 through a pin 7 and the other end thereof is rotatably mounted on the second bracket 2 through a pin 8 without crossing to the first link 3. Reference numeral 9 indicates a spring which is interposed between link connecting members 11 shown in FIG. 3 mounted in second bracket 2 for rotatably supporting the first bracket 1 with respect to the first link 3 and a flange portion 21 adjacent to the portion rotatably supporting the second bracket 2 with respect to the second link 6 and urges the first bracket 1 from the dotted line in FIG. 1 (i.e. the closing state of the hood) to the solid line (i.e. the opening state of the hood) by urging the pins 4,8 into an associating direction to one other.

A link connecting member 10 which is made of a plate spring is fixed to the second bracket 2, has an elastic operation. When the end portion of the first link 3 is rotated and is located at the fully opened state of the hood and the end portion of the first link 3, fixedly attaching an elastic member 31 made of plastic material etc. thereto is inserted between the plate spring 10 and the second bracket 2, the first link 3 is positively connected by an elastic splashing force or biasing force of the plate spring 10 and the frictional resistance of the elastic member 31.

The operation according to the invention will now be hereinafter described. In the case that the opening operation is attained from a fully closed state of the hood (i.e. the chain-dotted line in FIg. 1), each member is rotated and displaced to the solid line state shown as a fulcrum point of each pivotable portion, so that the first bracket 1 is raised to its fully opened state. At this time the one end of the first link 3, attached with the elastic member 31 fixedly inserted from the opening portion of the plate spring 10 and the first link 3, is positively connected by the frictional resistance between the elastic splashing force or biasing force of the plate spring 10 and the elastic member 31, and the hood is kept in its fully opened state.

Figure 3:
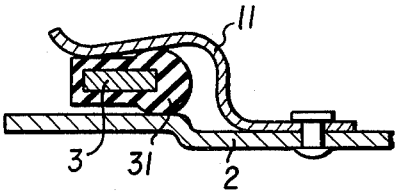
FIG. 3 shows a cross-sectional view showing a link connecting member.

Many embodiments of the link connecting member which connects the link to the fully opened state of the hood are contemplated by the present invention. In FIG. 3, the link member in the form of a plate spring 11 is fixedly attached to the bracket 2 which is fixed to the body by making the opening side narrow and the end portion of the link 3 attached with the elastic member 31 is inserted by extending the opening.

Figure 4:
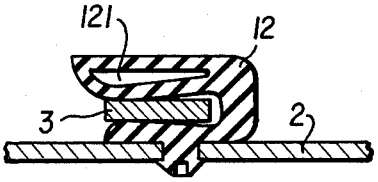
FIG. 4 shows a similar view to that FIG. 3, showing a second embodiment of a link connecting member.

In FIG. 4, a link connecting member is made of elastic member formed of plastics, etc. and the opening end is made narrow with the connecting member 12 forming a gap 121 on the lip portion thereof being fixedly attached to the bracket 2 fixed to the body. Also the opening is extended shrinking the gap 121 and the end portion of the link 3 is inserted into the opening by the elastic operation.

Figure 5:
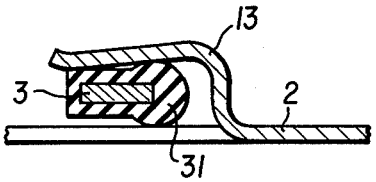
FIG. 5 shows a similar view to FIG. 3, showing a third embodiment of a link connecting member.
Figure 6:
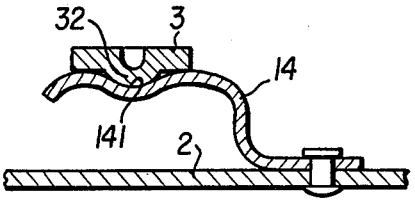
FIG. 6 shows a similar view to FIG. 3, showing a fourth embodiment of a link connecting member.

In FIG. 5, a link connecting member 13 forms a plate spring by partially cutting and raising the bracket 2. In FIG. 6, a link connecting member 14 forms a concave portion 141 on the plate spring and a convex portion 32 formed on the link 3 is inserted into the concave portion 141.

Also many embodiments relating to the link mechanism can be considered as substitutes for those described hereinabove Obviously many modifications and variations of the present invention are possible in light of the above teachings. It is therefore to be understood that within the scope of the appended claims the invention may be practiced otherwise than as specifically described herein.

What is claimed is:

1. A hinge structure for a hood and body of an automobile, which comprises:

a first bracket fixedly connected to said automobile's hood;

a second bracket fixedly connected to said automobile's body;

a link mechanism rotatably supporting said first and second brackets by means of first and second link members, said first link member having an axis of rotation;

means connected to said first bracket for urging said first bracket in a direction so as to raise said first bracket and said hood;

a link connecting member mounted on said second bracket member and an elastic member fixed to said automobile body adjacent said axis of rotation of said first link member wherein one end of said first link member is fixedly inserted into said link connecting member upon fully opening said automobile hood and is positively connected by the frictional resistance between the biasing force of said link connecting member and said elastic member.

2. A hinge structure for said autombile's hood as set forth in claim 1, wherein said link connecting member comprises a plate spring.

3. A hinge structure for said automobile's hood as set forth in claim 1, wherein said link connecting member is made of plastics.

4. A hinge structure for said automobile's hood as set forth in claim 1, wherein said link connecting member comprises a plate spring formed from said second bracket.

5. A hinge structure for said automobile's hood as set forth in claim 1, wherein said link connecting member forms a concave portion and said first link member includes a convex portion insertable into said concave portion of said link connecting member.

6. A hinge structure for said automobile's hood as set forth in claim 1, wherein said elastic member is mounted on one end of said first link member.

7. A hinge structure for said automobile's hood as set forth in claim 1 which further comprises:

first pivot means interconnecting said first bracket with said first link member; and second pivot means interconnecting said first link member with said second bracket.

8. A hinge structure for said automobile's hood as set forth in claim 7, which further comprises:

pivot means interconnecting said second link member with said first bracket and interconnecting said second link member with said second bracket.

* * * * *